US006345823B1

(12) United States Patent
Webb

(10) Patent No.: US 6,345,823 B1
(45) **Date of Patent: *Feb. 12, 2002**

(54) METHOD AND APPARATUS FOR PLAYING CARD GAMES

(75) Inventor: Derek J. Webb, Derby (GB)

(73) Assignee: Shuffle Master, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/249,118

(22) Filed: Feb. 12, 1999

Related U.S. Application Data

(60) Continuation-in-part of application No. 09/170,092, filed on Oct. 13, 1998, now Pat. No. 6,237,916, which is a continuation-in-part of application No. 08/889,919, filed on Jul. 10, 1997, now Pat. No. 6,056,641, which is a division of application No. 08/504,023, filed on Jul. 19, 1995, now Pat. No. 5,685,774.

(30) Foreign Application Priority Data

Jul. 22, 1994 (GB) ..... 9414822
Dec. 29, 1994 (GB) ..... 9426324

(51) Int. Cl.[7] ..... A63F 1/00
(52) U.S. Cl. ..... 273/292; 463/13
(58) Field of Search ..... 273/292, 309, 273/274; 463/13, 12, 46, 17

(56) References Cited

U.S. PATENT DOCUMENTS

| | | | | |
|---|---|---|---|---|
| 4,743,022 | A | 5/1988 | Wood | 273/292 |
| 4,836,553 | A | 6/1989 | Suttle et al. | 273/292 |
| 4,861,041 | A | 8/1989 | Jones et al. | 273/292 |
| 5,022,653 | A | 6/1991 | Suttle et al. | |
| 5,046,736 | A | 9/1991 | Bridgeman et al. | |
| 5,098,107 | A | 3/1992 | Boylan et al. | 273/292 |
| 5,174,579 | A | 12/1992 | Griffiths | 273/292 |
| 5,257,784 | A | 11/1993 | Boylan et al. | 273/138 |
| 5,257,810 | A | 11/1993 | Schorr et al. | 273/292 |
| 5,265,877 | A | 11/1993 | Boylan et al. | 273/139 |
| 5,275,415 | A | 1/1994 | Wisted | 273/274 |
| 5,288,081 | A | 2/1994 | Breeding | 273/292 |
| 5,294,128 | A | 3/1994 | Marquez | 273/292 |
| 5,308,065 | A | 5/1994 | Bridgeman et al. | 273/292 |
| 5,366,228 | A | 11/1994 | Kangsanaraks | 273/292 |
| 5,377,973 | A | 1/1995 | Jones et al. | 273/292 |

(List continued on next page.)

FOREIGN PATENT DOCUMENTS

GB 667345 2/1952

OTHER PUBLICATIONS

"Prime Table Games—Disclosure In Respect to Three Card Games," Derek J. Webb, Author, Feb. 10, 1999.

Copyright filing with the Bureau voor de Intellectuele Eigendom, Aruba, 13 pgs, (Jan. 13, 1988).

Published Rule Sheet for Casino Poker from Vegas World, 1 page, (1982).

"Card Craps", *Scarne's Encyclopedia of Card Games*, pp. 321–323, (1948).

*Primary Examiner*—Benjamin H. Layno
(74) *Attorney, Agent, or Firm*—Mark A. Litman & Assoc., P.A.

(57) ABSTRACT

A card game combines the play of a Poker-variant card game (e.g., three-, four-, and five-card Poker) with a proposition game (e.g., Pair Plus). Players wagering against a dealer's hand also wager against a predetermined ranking of winning hands, and may place additional wagers. According to another aspect, players are provided with a wild card which is retained and used repeatedly by each player with each hand.

34 Claims, 2 Drawing Sheets

U.S. PATENT DOCUMENTS 5,377,993 A 1/1995 Josephs ..... 463/12
5,397,128 A 3/1995 Hesse et al. ..... 273/292
5,431,408 A 7/1995 Adams ..... 273/306
5,489,101 A 2/1996 Moody ..... 273/292
5,505,449 A 4/1996 Eberhardt et al. ..... 463/17
5,531,448 A 7/1996 Moody ..... 273/292
5,538,252 A 7/1996 Green ..... 273/306
5,584,486 A 12/1996 Franklin ..... 273/292
5,630,757 A 5/1997 Gagin et al. ..... 463/43
5,653,444 A 8/1997 Dahl ..... 273/274
5,673,917 A 10/1997 Vancura ..... 273/292
5,685,774 A 11/1997 Webb ..... 463/13
5,732,950 A 3/1998 Moody ..... 273/292

METHOD AND APPARATUS FOR PLAYING CARD GAMES

This Application is a continuation-in-part of U.S. Ser. No. 09/170,092, filed Oct. 13, 1998, now U.S. Pat. No. 6,237,916 which is a continuation-in-part of U.S. patent application Ser. No. 08/889,919, filed Jul. 10, 1997, now U.S. Pat. No. 6,056,641, which is a division of U.S. patent application Ser. No. 08/504,023, filed Jul. 19, 1995, now U.S. Pat. No. 5,685,774.

BACKGROUND OF THE INVENTION

1. Field of the Invention

The invention relates to card games. More particularly, the invention relates to card-type games suitable for gaming establishments and other environments.

2. Description of Related Art

Casinos and leisure establishments continually require new games to offer their clientele. Such games are generally required to enable each player to play against a banker (who usually also acts as dealer) provided by the casino, rather than against other players. Alternatively, in a "card room" game, each player may have the option to act as banker while the establishment runs the game on behalf of the banker and takes fees from the players.

Players typically enjoy games which can be played rapidly and which offer players a plurality of choices. A plurality of choices heightens player interest in games. It would therefore be desirable to provide card games including a plurality of new wagering options.

Games have been disclosed incorporating multiple wagering choices for players; but often players have the misconception that one of the multiple wagering options is better than the others. As a result, the players only play one of the options to their own detriment as well as to the casino operator's detriment. Additionally, if a dealer perceives that one of the multiple wagering options will generate more dealer tips than the others, the dealers may suggest to the players that one wager is better than the others.

SUMMARY OF THE INVENTION

The present invention provides card games that combine the play of a Poker-variant card game (e.g., three-, four-, and five-card Poker) with a proposition game (e.g., Pair Plus). In a casino embodiment, the invention can be played in conjunction with a conventional casino-type table and a single standard deck of 52 playing cards. In such an embodiment, the table also displays a payoff scale on the proposition game and further instructional and promotional information.

In a three-card embodiment of the present invention, each player places an Ante wager and a Pair Plus wager at the beginning of a round of the game. The Ante wager is a bet that the player will receive a hand with a higher rank than that of a dealer. The Pair Plus wager is a bet that the player's hand will have a higher rank than a predetermined rank (e.g., a Pair).

The dealer then deals himself (face-down) and each player three cards (either face-up or face-down). Each player, after inspecting his hand, places a Play wager if he desires to continue with the round. If, however, a player chooses not to proceed, his Ante and Pair Plus wagers are forfeited and his cards are discarded. The dealer then reveals his hand and those of each player (if not already visible) and resolves each player's wager.

A wild card can also be used with the present invention. Such cards are distinguishable from the other cards in play and can also serve as a memento and/or a promotional item to be retained by the player.

As the invention can be practiced on existing casino tables, the invention provides casino operators with additional revenue generating features without requiring extra casino tables, space, or game surveillance.

The invention can also be readily implemented in a wide variety of additional forms and media including, single player slot video machines, multi-player slot video machines, electronic games and devices, lottery terminals, scratch-card formats, software, as well as in-flight, home and Internet entertainment. Moreover, the invention can be readily implemented in software, which can be stored on a disk (e.g., magnetic disk, compact disk (CD), etc.) and used with a computer system.

These and other features of the invention are embodied in a method of playing a card game, including the steps of (a) receiving a first wager from a player that a first outcome will occur; (b) receiving a second wager from the player that a second outcome will occur, wherein: both the first wager and the second wager must be received to play the game, a larger of the first wager and the second wager is a primary wager, and a smaller of the first wager and the second wager is a secondary wager, and the primary wager cannot exceed a predetermined multiple of the secondary wager; (c) dealing hands of cards to the player and to a dealer; (d) receiving an optional third wager from the player, wherein if the third wager is not received, the player forfeiting at least one of the first wager and the second wager; (e) comparing the dealer's hand with the player's hand, (e1) if the player's hand is higher than the dealer's hand, paying the player an amount based on the third wager and one of the first wager and the second wager, and (e2) if the player's hand is lower than the dealer's hand, the player forfeiting the third wager and the one of the first wager and the second wager; and (f) determining whether the player's hand exceeds a first predetermined rank, (f1) if the player's hand exceeds the first predetermined rank, paying the player an amount based on the other of the first wager and the second wager, and (f2) if the player's hand does not exceed the first predetermined rank, the player forfeiting the other of the first wager and the second wager.

The predetermined multiple is at least 2, and is preferably 5. Between steps (d) and (e), the method may further include the step of determining whether the dealer's hand exceeds a second predetermined rank, wherein if the dealer's hand does not exceed the second predetermined rank, paying the player an amount based on the one of the first wager and the second wager, returning the third wager to the player, and proceeding to step (f). Step (f1) is preferably practiced by paying the player in accordance with a pay scale.

The first outcome may be the player's hand exceeding the dealer's hand, and the second outcome may be the player's hand being at least the first predetermined rank and vice versa.

The player's hand and the dealer's hand may be five-card poker hands or three-card poker hands or any other suitably numbered card hand.

In accordance with another aspect of the invention, the invention is embodied in a method of playing a card game, including the steps of (a) receiving a first wager from a player that a first outcome will occur; (b) receiving a second wager from the player that a second outcome will occur, wherein both the first wager and the second wager must be received to play the game, a larger of the first wager and the second wager is a primary wager, and a smaller of the first wager and the second wager is a secondary wager, and the primary wager cannot exceed a predetermined multiple of the secondary wager; (c) dealing hands of cards to the player and to a dealer; (d) resolving the game in accordance with predetermined game rules; and (e) resolving the first wager and the second wager based on whether the first outcome occurred and whether the second outcome occurred.

BRIEF DESCRIPTION OF THE DRAWINGS

The foregoing, and other features and advantages of the invention, will be apparent from the following, more detailed description of the preferred embodiments of the invention in conjunction with the accompanying drawings, in which.

DETAILED DESCRIPTION OF PREFERRED EMBODIMENTS

Figure 1:
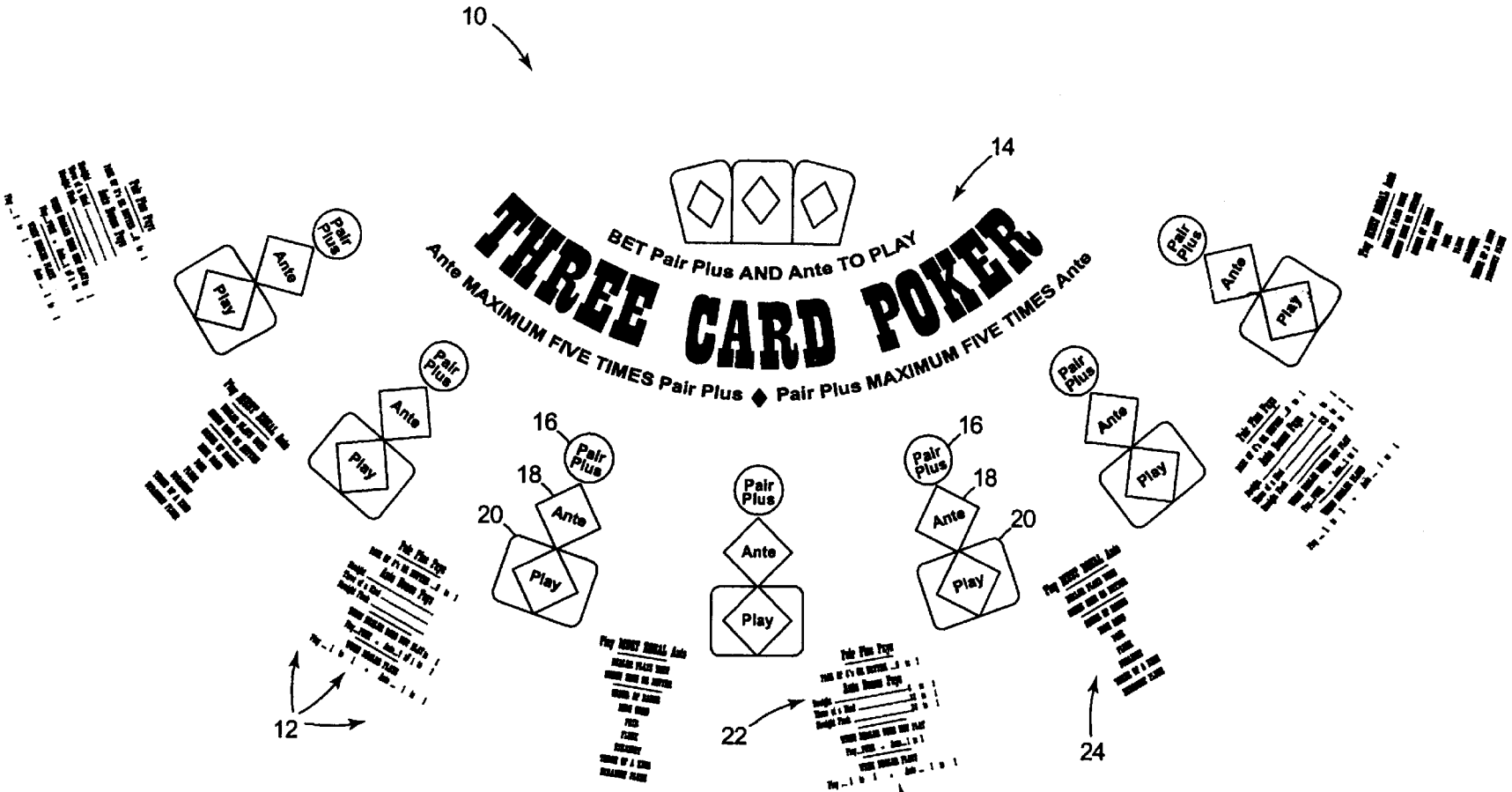
FIG. 1 illustrates a playing surface (layout) of a casino-type table in accordance with the invention.

Preferred embodiments of the invention are now described with reference to the FIGURES.

The various embodiments of the present invention are directed to card-type games wherein indicia of playing cards are displayed to one or more players and/or a dealer. As used herein, the phrase "indicia of playing cards" is meant to include actual playing cards, as well as images of playing cards displayed either mechanically, electro-mechanically, electronically or otherwise. For example, it is well within the scope of the present invention to display indicia of playing cards on an actual board, on a mechanical slot machine, on an electronic gaming device, on another video screen, or utilizing another form of image generation such as holography. Similarly, the phrase "indicia of wild cards" as used herein may include jokers from a standard deck of playing cards, but may also comprise other indicia which, according to rules of the game, may be used for at least one other value.

The present application provides improvements over the card games taught in commonly-owned U.S. Pat. No. 5,685,774 to Webb and commonly-owned, copending U.S. patent application Nos. 09/170,092 and 08/889,919, now U.S. Pat. No. 6,056,641, the disclosures of which are incorporated herein by reference.

The card games taught in U.S. Pat. No. 5,685,774 provide players the choice of betting their hands against a dealer hand (e.g., an "Ante" wager), or against a predetermined rank (e.g., A "Pair Plus" wager), or placing both wagers.

Although these wager features provide for a dynamic gaming experience, practice has shown that players tend to have a bias toward Pair Plus wagering. Accordingly, some of the unique advantages of the card games taught in the foregoing patent are not consistently realized in practice. Players appear to choose the Pair Plus wager option, at exclusion of the Ante option, for a number of reasons. Firstly, in a casino environment, table layout design requires that the higher odds payoff bet is placed closest to the dealer, and new players tend to automatically bet the wager closest to the dealer if they are unfamiliar with the game. Secondly, dealer wages are basic minimums and are supplemented by tips or tokes, so if dealers perceive that a certain method of play generates more tokes, then that mode of play is encouraged. Although the perception is erroneous, this is the case with the Pair Plus wager. Thirdly, some players play poorly when playing Ante and have a more negative experience than they should, and thus gravitate towards the Pair Plus wager. Fourthly, some casinos may not have utilized best methods of shuffling for this type of game, which may have resulted in more premium hands being generated than was expected by random distribution.

As a result of these various factors, such embodiments operate at less than optimal levels. For example, with a player bias toward Pair Plus waging, player win frequency is lower. Secondly, there is less player-dealer interaction, and thus the sociability aspect of the game is adversely effected. Thirdly, the game does not appear as attractive to a spectator trying to learn the game. Fourthly, the overall volume of business is reduced when some players are not exploiting all the wager options. Fifthly, the casino results are more volatile as more wagers are concentrated on the higher payoff scale. Sixthly, the combined factors described impact unfavorably on the casinos' most commonly used measurement of relative game merit, the hold percentage.

The present invention provides card games that also combine the play of a Poker-variant card game (e.g., three-, four-, and five-card Poker) with a proposition game (e.g., Pair Plus). However, the wager options in the present invention are structured to ensure greater overall game performance.

FIG. 1 illustrates a playing surface or table layout 10 on which one embodiment of the present invention may be played. Layout 10 may be marked or placed on any suitable surface such as a gaming table. For example, the layout may be in the form of a layout cloth supported on a supporting surface. In general, the invention can be practiced on existing casino tables, thus providing casino operators with additional revenue generating features without requiring extra casino tables, space, or game surveillance.

Layout 10 provides a playing area 12 for a plurality of players, for example seven players, and a separate area 14 for a banker who also preferably acts as a dealer. Each playing area 12 has a number of marked sections or zones 16, 18, and 20 for the player to place various wagers as will be described hereinafter. Layout 10 also displays various payout schedules 22, 24, and 26. Other wager areas and/or information can be displayed on layout 10, such as the "Three Card Poker" promotional markings illustrated in FIG. 1.

Each player takes a place at one of the playing areas 12. The game is played in a number of rounds as will be described. In each round, each player plays against the dealer and also wagers on the rank of his hand. Both wagers must be received to play the game. The game can be played with a standard 52-card deck or a modified deck as would be recognized by one of ordinary skill in the art.

At the commencement of a game, each player who decides to play a particular round of the game must make a first wager on the value of that player's hand against that of the dealer (Ante wager) and a second wager that the player's hand will exceed a predetermined rank (Pair Plus wager). Each player makes an Ante wager by placing an appropriate wager, such as a chip, in section 18 of his playing area 12. The gaming chips may be of any conventional kind and available in a number of denominations such as are well known within the art. The player also makes the second Pair Plus wager based on the value of his hand, by placing an appropriate chip in section 16 of his playing area 12. According to the present invention, as noted, both the first wager and the second wager must be made by the player to play the game.

According to the rules of the game, a larger of the first wager and the second wager is considered a primary wager, and the smaller is considered a secondary wager. The primary wager cannot exceed a predetermined multiple of the secondary wager, within casino minimum and maximum limits. In preferred forms, the predetermined multiple is between 2 and 10 and is preferably 5. In the present example, the rules of the game provide that payouts for the Pair Plus wager will be made according to displayed payout schedules 22 (Pair Plus payouts starting at a pair or better).

In a three-card version of the game, hands are preferably ranked according to the following hierarchy, wherein A=Ace, K=King, Q=Queen, J=Jack, and numbers 10 to 2 designate the other cards:

| | | |
|---|---|---|
| Highest: | Straight Flush: | Three of one suit in sequence<br>AKQ highest<br>KQJ next highest<br>QJ10 next highest,<br>and so on, until<br>32A lowest |
| | Three of a Kind: | Three of one rank<br>AAA highest<br>KKK next highest,<br>and so on, until<br>222 lowest |
| | Straight: | Three of mixed suits in sequence<br>AKQ highest<br>KQJ next highest,<br>and so on, until<br>32A lowest |
| | Flush: | Three of one suit<br>AKJ highest<br>AK10 next highest,<br>and so on, until<br>532 lowest |
| | Pair: | Two of same rank<br>AAK highest<br>AAQ next highest,<br>and so on, until<br>223 lowest |
| Lowest: | High card: | A hand comprising none of the above<br>AKJ highest<br>AK10 next highest,<br>and so on, until<br>532 lowest |
| | Ace is high, but can be low in 3-2-A sequence | |

As would be apparent to one skilled in the art other rankings can be practiced with the invention.

Additionally, for hands other than three cards, rankings would be suitably changed as would predetermined ranks and payouts. One skilled in the art will appreciate that other rankings can be practiced with the invention and that various other names may be used for the hands in the illustrative hierarchy set forth herein. For example, Straight Flush may also be known as a Brag or Bouncer, Three of a Kind may also be known as Trips or Prile; and a Straight may also be known as a Run.

The payout schedule may be varied in accordance with rules of the game and/or by the casino. For example, as illustrated in FIG. 1 (schedule 22), the payout schedule of this preferred embodiment pays 3 to 1 on a pair of 3s or better.

Alternatively, in a gaming establishment or jurisdiction where high odds payouts are not favored, a wager can be made that the value of the hand will be a Pair or greater, and the payout may be, for example, 14 to 5. In accordance with another alternative, the lowest winning pair could be higher than twos, such as a pair of threes, with a corresponding higher payout. One skilled in the art will appreciate that payouts may be varied without departing from the scope of the invention.

The payout schedules are preferably displayed in a convenient manner and location. The details of payouts and any other payouts (e.g., extra bonus) may be marked on each player's playing area 12 as illustrated in FIG. 1. However, alternative arrangements can be used with the invention.

According to a preferred embodiment of the present invention, as discussed above, the wagers are related as a primary wager and a secondary wager, with the primary wager being merely the larger of the two. This wager may be determined by the player at the player's option or may be set by the casino. The primary wager preferably cannot exceed a predetermined multiple of the secondary wager, such as 5, for example, within casino minimum and maximum limits.

After the above wagers are placed, the dealer preferably shuffles the cards (manually or otherwise) and then deals a three-card hand to each player and to himself. The cards may initially be dealt to the players face-up or face-down depending on casino policy. All the dealer's cards are dealt face-down in this preferred embodiment.

After the cards have been dealt, the player inspects his hand and determines whether he wishes either to forfeit his Ante wager and not to play the hand, or to continue. If he wishes to continue, according to this illustrated embodiment, he must place a Play wager, which must be of proportionate value to and is preferably the same as the Ante wager. The Play wager is made by placing an appropriate chip in section 20 of his playing area 12. After making the Play wager, the player places his cards in the area below section 20.

The player must make a Play wager if he has a winning Pair Plus wager.

At this point, the dealer then reveals his cards and arranges the cards to show the value of his hand. The dealer then in turn reveals each other player's hand (if not already visible) and resolves each player's wagers.

All players with Ante and Play wagers are automatically winners if the dealer hand does not exceed a predetermined rank such as a Queen high hand or better. This rank may be varied in accordance with rules of the game or of the casino. As is illustrated in FIG. 1 (schedule 26), if the dealer hand does not exceed the predetermined rank, players are preferably paid even money (one to one) on their Ante wager, and their Play wager is returned (a Push).

If the dealer's hand exceeds the predetermined rank, each player's hand is compared with that of the dealer. If the player's hand is higher (i.e., the rank of the player's hand exceeds that of the dealer's hand), the player is paid even money on both Ante and Play wagers (schedule 26). If the player's hand is lower, the player forfeits his Ante and Play wagers. If the dealer and player have the same hand, the player may either withdraw his wager or leave or amend it for the next round.

Preferably an additional extra bonus payout (e.g., Ante Bonus) is made by the banker to any player who is in play against the dealer (i.e., who has made the Ante and Play wagers) and who has a hand of a high rank. The ranks to which such extra bonus payouts are made may be predetermined by rules of the game and/or the casino. For example, as illustrated in FIG. 1 (schedule 26), the extra bonus payout schedule of this preferred embodiment is as follows:

| | |
|---|---|
| Straight Flush | 5 × 1 |
| Three of a Kind | 4 × 1 |
| Straight | 1 × 1 |

Alternatively, the extra bonus payout may be 7 to 5 for a Straight or higher ranking hand. The extra bonus payout is preferably based on the Ante wager.

This procedure completes a single round of the game. Play then continues in another round, with players commencing by making both Ante and Pair Plus wagers.

The present invention can also be practiced with a wild card. The wild card is a combined playing and promotional card that may be used separately or in conjunction with one of the other embodiments of the present invention. Examples of such wild cards are as illustrated and described in U.S. Pat. No. 5,685,774. The wild card provides a dual function. As discussed below, during the play of the game, in accordance with the invention, the card can be used as a wild card. Subsequent to the game, the card can be taken away by the player and retained as a memento and also serves as a promotional item.

In a three-card version of the game described above, a player may be provided with two standard cards and a wild card to form a three-card Poker hand. Alternatively, at least one player may be provided with three cards and be permitted to discard one card in order to form his best three-card hand using the wild card.

Similarly, in four- and five-card versions of the game, a wild card can be issued to each player and to the dealer. The players and dealer then use the wild card repeatedly in conjunction with each four-card hand dealt to them to make a five-card Poker hand. In a five-card game, each player and the dealer may substitute the wild card for any card in their hand to improve the five-card hand they hold. This has the result of creating higher hand values and adding excitement to the game. According to each of these embodiments, the dealer is also preferably provided with the same number of standard cards and a wild card as provided to each player.

From the present description, those skilled in the art will appreciate that various modifications may be made without departing from the scope of the present invention. For example, the naming of the wagers, the naming and/or ranking of any hand, the payout schedule and predetermined winning or losing ranks may be varied in accordance with the requirements of the casino. The table layout may be varied from that described and shown. The rules may be varied, or additional rules imposed, within the scope of the invention.

In addition, the present invention can be practiced with a further option of a player wagering on a high odds payout wager or on a fixed or variable jackpot which is paid out in accordance with rules of the casino on a premium hand, or when a high ranked hand is beaten by the dealer. Examples of odds available could be 5000 to 1 or more against a Royal Flush-Ace, King, Queen suited or up to 250,000 to 1 or more against a Straight Flush being beaten by a higher Straight Flush. In addition, the player's hand may be combined with the dealer's hand to form a six-card hand offering odds of up to 4,000,000 to 1 or more against Ace to nine in the same suit (i.e., Ace, King, Queen, Jack, 10 and 9 suited). Two or more of these wagers could be combined with suitably reduced odds, and if desired, consolation payouts could be made to players having hands less than the premium hand and/or to other players who have taken part in the jackpot. As would be understood by those of ordinary skill in the art, the jackpot bet is typically a fixed-stake bet paying high odds on a very low-frequency occurrence. In the present example, the fixed stake jackpot bet according to a preferred embodiment is $1.

According to another embodiment of the present invention, a player may be provided with a payout based on one or more of the following:

(a) a player's hand of a specified ranking is an automatic winner, with a payout based either on the Ante or the Play wager or both, regardless of the contest against the dealer (i.e., even if the dealer has a higher hand than the player);

(b) a player's hand of specified ranking could be an automatic non loser (i.e., the players stake is returned) based on either the Ante or Play wager or both regardless of the contest against the dealer (i.e., even if the dealer has a higher hand); and/or (c) a player's hand of specified ranking could win the Play wager if the dealer's hand is of a specified ranking below the dealer's minimum specified ranking (i.e., in the embodiment described above the specified ranking is, e.g., Queen high or better, so that the additional specified ranking could be Jack high).

In addition, another jackpot wager can be used with the present invention. This jackpot wager can have a high payoff on premium hands only. One preferred payout schedule is as follows:

| | |
|---|---|
| Straight Flush | 255 to 1 |
| Three of a Kind | 200 to 1. |

Also, Ace, King, and Queen suited could be called a Royal Flush with the following preferred payout schedule:

| | |
|---|---|
| Royal Flush | 1,000 to 1 |
| Straight Flush | 200 to 1 |
| Three of a Kind | 150 to 1. |

Furthermore, if desired, an additional wager may be placed on the total numerical value of a player's hand. For example, picture cards preferably count as ten points, Aces count as one point, and the other cards two to ten points, the total being compared to the dealer's total and the higher total winning. Tied hands may be won by the dealer or half stakes won by the dealer on tied hands.

Where the game incorporates jackpot and/or numerical hand value wagers, separate designated wagering areas may be provided for these wagers. These areas may be incorporated at any convenient position on the players playing areas. In addition, the wild and promotional card may also be modified or omitted as desired in such embodiments with jackpot and/or numerical hand value wagers.

Figure 2:
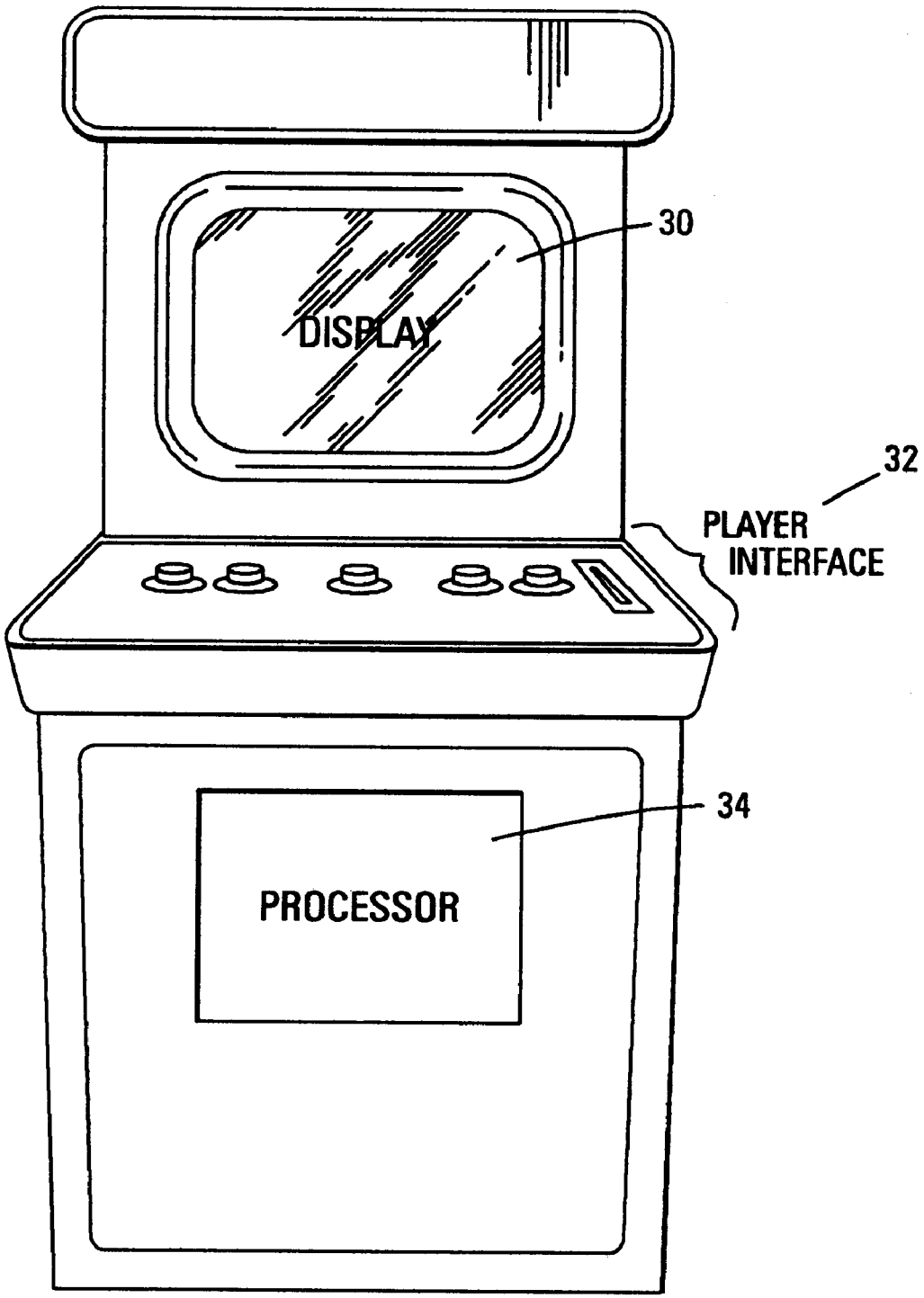
FIG. 2 is a schematic illustration of an apparatus according to the invention.

While the foregoing preferred embodiments have been particularly described for play in a gaming establishment environment, it would be apparent to one skilled in the relevant art that the present invention can be embodied in a wide variety of forms and media including, but not limited to, single player slot video machines, multi-player slot video machines, electronic games and devices, lottery terminals, scratch-card formats, software, as well as in-flight, home, and Internet entertainment. For example, referring to FIG. 2, a block diagram is illustrated showing the components of an apparatus configured for playing the card game according to the invention. The apparatus includes a display 30, a player interface 32, and circuitry 34 for effecting game play. The processing circuit 34 effects game play in accordance with the rules of the game.

The gaming devices can facilitate games for a single player against the playing device; however, it is also within the scope of the present invention to provide a multi-unit video format wherein a plurality of players may play against each other and/or against a dealer. Those skilled in the art will appreciate that suitable controls can be provided for receiving and processing the necessary inputs and therefore will not be described in detail herein. In addition, the invention can be readily implemented as a computer program product (e.g., floppy disk, compact disk (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing a card game, comprising the steps of:

(a) receiving a first wager from a player that a first outcome will occur;

(b) receiving a second wager from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

(c) dealing hands of cards to the player and to a dealer;

(d) receiving an optional third wager from the player, wherein if the third wager is not received, the player forfeiting at least one of the first wager and the second wager;

(e) comparing the dealer's hand with the player's hand, (e1) if the player's hand is higher than the dealer's hand, paying the player an amount relative to the third wager and one of the first wager and the second wager, and (e2) if the player's hand is lower than the dealer's hand, the player forfeiting the third wager and the at least one of the first wager and the second wager; and (f) determining whether the player's hand exceeds a first predetermined rank, (f1) if the player's hand exceeds the first predetermined rank, paying the player an amount relative to the other of the first wager and the second wager, and (f2) if the player's hand does not exceed the first predetermined rank, the player forfeiting the other of the first wager and the second wager.

2. A method according to claim 1, wherein the predetermined multiple is at least 2.

3. A method according to claim 2, wherein the predetermined multiple is 5.

4. A method according to claim 1, further comprising between steps (d) and (e) the step of determining whether the dealer's hand exceeds a second predetermined rank, wherein if the dealer's hand does not exceed the second predetermined rank, paying the player an amount based on the one of the first wager and the second wager, returning the third wager to the player, and proceeding to step (f).

5. A method according to claim 1, wherein step (f1) is practiced by paying the player in accordance with a pay scale.

6. A method according to claim 1, wherein the first outcome is the player's hand exceeding the dealer's hand, and wherein the second outcome is the player's hand being at least the first predetermined rank, such that the one of the first wager and the second wager is the first wager and the other of the first wager and the second wager is the second wager.

7. A method according to claim 1, wherein the second outcome is the player's hand exceeding the dealer's hand, and wherein the first outcome is the player's hand being at least the first predetermined rank, such that the one of the first wager and the second wager is the second wager and the other of the first wager and the second wager is the first wager.

8. A method according to claim 1, wherein the player's hand and the dealer's hand are five-card poker hands.

9. A method according to claim 1, wherein the player's hand and the dealer's hand are three-card poker hands.

10. A method of playing a card game, comprising the steps of:

(a) receiving a first wager in a first amount from a player that a first outcome will occur;

(b) receiving a second wager in a second amount from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

(c) dealing hands of cards to the player and to a dealer;

(d) resolving the game in accordance with predetermined game rules; and (e) resolving the first wager and the second wager based on whether the first outcome occurred and whether the second outcome occurred, (f) the resolving of the first wager and the resolving of the second wager being relative to the first amount and relative to the second amount, respectively.

11. A method according to claim 10, wherein the predetermined multiple is at least 2.

12. A method according to claim 11, wherein the predetermined multiple is 5.

13. A method according to claim 10, wherein the first outcome is the player's hand exceeding the dealer's hand, and wherein the second outcome is the player's hand being at least a predetermined rank.

14. A method according to claim 10, wherein the second outcome is the player's hand exceeding the dealer's hand, and wherein the first outcome is the player's hand being at least a predetermined rank.

15. A method according to claim 10, wherein the player's hand and the dealer's hand are five-card poker hands.

16. A method according to claim 10, wherein the player's hand and the dealer's hand are three-card poker hands.

17. A method according to claim 10, wherein step (e) is practiced by resolving one of the first wager and the second wager according to a pay scale.

18. An apparatus configured for playing a card game comprising a display, a player interface for receiving player input, and circuitry for effecting game play and comprising:

means for receiving a first wager from a player that a first outcome will occur;

means for receiving a second wager from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

means for dealing hands of cards to the player and to a dealer;

means for receiving an optional third wager from the player, wherein if the third wager is not received, the player forfeiting at least one of the first wager and the second wager;

a summing circuit that determines a numerical total of the player's hand and the dealer's hand; and a processing circuit effecting game play based on the numerical total of the player's hand and the numerical total of the dealer's hand, such that:

(1) if the player's hand is higher than the dealer's hand, paying the player an amount relative to the third wager and one of the first wager and the second wager, and (2) if the player's hand is lower than the dealer's hand, the player forfeiting the third wager and the one of the first wager and the second wager, (3) if the player's hand exceeds a predetermined rank, paying the player an amount relative to the other of the first wager and the second wager, and (4) if the player's hand does not exceed the predetermined rank, the player forfeiting the other of the first wager and the second wager.

19. An apparatus according to claim 18, wherein the predetermined multiple is at least 2.

20. An apparatus according to claim 19, wherein the predetermined multiple is 5.

21. An apparatus configured for playing a card game comprising a display, a player interface for receiving player input, and circuitry for effecting game play and comprising:

means for receiving a first wager from a player that a first outcome will occur;

means for receiving a second wager from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

means for dealing hands of cards to the player and to a dealer;

means for resolving the game in accordance with predetermined game rules; and means for resolving the first wager and the second wager based on whether the first outcome occurred and whether the second outcome occurred, the means for resolving of the first wager and the resolving of the second wager resolving the first and second wager relative to the first amount and relative to the second amount, respectively.

22. An apparatus according to claim 21, wherein the predetermined multiple is at least 2.

23. An apparatus according to claim 22, wherein the predetermined multiple is 5.

24. An apparatus configured for playing a card game comprising a display, a player interface for receiving player input, and a processor configured to effect game play, the processor enabling:

(a) receiving a first wager from a player that a first outcome will occur;

(b) receiving a second wager from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

(c) dealing hands of cards to the player and to a dealer;

(d) receiving an optional third wager from the player, wherein if the third wager is not received, the player forfeiting at least one of the first wager and the second wager;

(e) comparing the dealer's hand with the player's hand, (e1) if the player's hand is higher than the dealer's hand, paying the player an amount relative to the third wager and one of the first wager and the second wager, and (e2) if the player's hand is lower than the dealer's hand, the player forfeiting the third wager and the one of the first wager and the second wager; and (f) determining whether the player's hand exceeds a first predetermined rank, (f1) if the player's hand exceeds the first predetermined rank, paying the player an amount relative to the other of the first wager and the second wager, and (f2) if the player's hand does not exceed the first predetermined rank the player forfeiting the other of the first wager and the second wager.

25. An apparatus according to claim 24, wherein the predetermined multiple is at least 2.

26. An apparatus according to claim 25, wherein the predetermined multiple is 5.

27. An apparatus configured for playing a card game comprising a display, a player interface for receiving player input, and a processor configured to effect game play, the processor enabling:

(a) receiving a first wager of a first amount from a player that a first outcome will occur;

(b) receiving a second wager of a second amount from the player that a second outcome will occur, wherein:

both the first wager and the second wager must be received to play the game, a larger of the first wager and the second wager is a primary wager, and a smaller of the first wager and the second wager is a secondary wager, and the primary wager cannot exceed a predetermined multiple of the secondary wager;

(c) dealing hands of cards to the player and to a dealer;

(d) resolving the game in accordance with predetermined game rules; and (e) resolving the first wager and the second wager based on whether the first outcome occurred and whether the second outcome occurred (f) resolving of the first wager and the resolving of the second wager relative to the first amount and relative to the second amount respectively.

28. An apparatus according to claim 27, wherein the predetermined multiple is at least 2.

29. An apparatus according to claim 28, wherein the predetermined multiple is 5.

30. A method of playing a card game, comprising the steps of:

(a) receiving a first wage r from a player that a first outcome will occur;

(b) receiving a second wager from the player that a second outcome will occur, wherein:

both the first wager and the second wager must be received to play the game, (c) dealing hands of cards to the player and to a dealer;

(d) receiving an optional third wager from the player, wherein if the third wager is not received, the player forfeiting at least one of the first wager and the second wager;

(e) comparing the dealer's hand with the player's hand, (e1) if the player's hand is higher than the dealer's hand, paying the player an amount relative to the third wager and one of the first wager and the second wager, and (e2) if the player's hand is lower than the dealer's hand, the player forfeiting the third wager and the at least one of the first wager and the second wager; and (f) determining whether the player's hand exceeds a first predetermined rank, (f1) if the player's hand exceeds the first predetermined rank, paying the player an amount relative to the other of the first wager and the second wager, and (f2) if the player's hand does not exceed the first predetermined rank, the player forfeiting the other of the first wager and the second wager.

31. A method of playing a card game, comprising the steps of:

(a) receiving a first wager in a first amount from a player that a first outcome will occur;

(b) receiving a second wager in a second amount from the player that a second outcome will occur, wherein:

both the first wager and the second wager must be received to play the game, (c) dealing hands of cards to the player and to a dealer;

(d) resolving the game in accordance with predetermined game rules; and (f) resolving the first wager and the second wager based on whether the first outcome occurred and whether the second outcome occurred, (f) the resolving of the first wager and the resolving of the second wager being relative to the first amount and relative to the second amount, respectively.

32. An apparatus configured for playing a card game comprising a display, a player interface for receiving player input, and circuitry for effecting game play and comprising:

means for receiving a first wager from a player that a first outcome will occur;

means for receiving a second wager from the player that a second outcome will occur, wherein:

both the first wager and the second wager must be received to play the game, means for dealing hands of cards to the player and to a dealer;

means for resolving the game in accordance with predetermined game rules; and means for resolving the first wager and the second wager based on whether the first outcome occurred and whether the second outcome occurred, the means for resolving of the first wager and the resolving of the second wager resolving the first and second wager relative to the first amount and relative to the second amount, respectively.

33. An apparatus configured for playing a card game comprising a display, a player interface for receiving player input, and a processor configured to effect game play, the processor enabling:

(a) receiving a first wager from a player that a first outcome will occur;

(b) receiving a second wager from the player that a second outcome will occur, wherein:

both the first wager and the second wager must be received to play the game, (c) dealing hands of cards to the player and to a dealer;

(d) receiving an optional third wager from the player, wherein if the third wager is not received, the player forfeiting at least one of the first wager and the second wager;

(e) comparing the dealer's hand with the player's hand, (e1) if the player's hand is higher than the dealer's hand, paying the player an amount relative to the third wager and one of the first wager and the second wager, and (e2) if the player's hand is lower than the dealer's hand, the player forfeiting the third wager and the one of the first wager and the second wager; and (f) determining whether the player's hand exceeds a first predetermined rank, (f1) if the player's hand exceeds the first predetermined rank, paying the player an amount relative to the other of the first wager and the second wager, and (f2) if the player's hand does not exceed the first predetermined rank the player forfeiting the other of the first wager and the second wager.

34. An apparatus configured for playing a card game comprising a display, a player interface for receiving player input, and a processor configured to effect game play, the processor enabling:

(a) receiving a first wager of a first amount from a player that a first outcome will occur;

(b) receiving a second wager of a second amount from the player that a second outcome will occur, wherein:

both the first wager and the second wager must be received to play the game, (c) dealing hands of cards to the player and to a dealer;

(d) resolving the game in accordance with predetermined game rules; and (f) resolving the first wager and the second wager based on whether the first outcome occurred and whether the second outcome occurred (f) resolving of the first wager and the resolving of the second wager relative to the first amount and relative to the second amount, respectively.

* * * * *